US005296783A

United States Patent [19]

Fischer

[11] Patent Number: 5,296,783

[45] Date of Patent: Mar. 22, 1994

[54] DUAL FILAMENT LAMP AND DRIVE APPARATUS FOR DIMMABLE AVIONICS DISPLAYS

[75] Inventor: Gregory M. Fischer, Cedar Rapids, Iowa

[73] Assignee: Rockwell International Corporation, Seal Beach, Calif.

[21] Appl. No.: 876,832

[22] Filed: Apr. 30, 1992

Related U.S. Application Data

[63] Continuation-in-part of Ser. No. 709,942, Jun. 4, 1991, Pat. No. 5,250,877.

[51] Int. Cl.[5] ..... H01J 7/44

[52] U.S. Cl. ..... 315/64; 315/65; 315/68; 315/291; 315/307; 315/DIG. 4; 313/558; 313/549

[58] Field of Search ..... 315/64, 65, 68, 291, 315/307, DIG. 4; 313/558, 549

[56] References Cited

U.S. PATENT DOCUMENTS

| | | | |
|---|---|---|---|
| 2,762,968 | 9/1956 | Majercak | 323/89 |
| 2,928,989 | 3/1960 | Bird | 315/90 |
| 3,184,637 | 5/1965 | Skinner | 315/129 |
| 3,309,563 | 3/1967 | McKienzie | 315/83 |
| 3,504,218 | 3/1970 | Emidy | 313/212 |
| 4,458,179 | 7/1984 | Bainbridge et al. | 315/65 |
| 4,475,062 | 10/1984 | Radenkovich et al. | 315/88 |
| 4,527,095 | 7/1985 | Herring | 315/65 |
| 4,734,616 | 3/1988 | Northrop | 313/492 |
| 4,754,201 | 6/1988 | Knoble et al. | 315/130 |
| 4,862,038 | 8/1989 | Morten | 315/86 |
| 4,945,280 | 7/1990 | Beghelli | 315/129 |
| 5,003,224 | 3/1991 | Hiljanen | 315/65 |
| 5,172,034 | 12/1992 | Brinkerhoff | 315/219 |

FOREIGN PATENT DOCUMENTS

| | | | |
|---|---|---|---|
| 50-78977 | 6/1975 | Japan | H01K 9/02 |

*Primary Examiner*—Robert J. Pascal
*Assistant Examiner*—Haissa Philogene
*Attorney, Agent, or Firm*—Gregory G. Williams; M. Lee Murrah; H. Fredrick Hanamm

[57] ABSTRACT

An improved dimmable dual filament fluorescent lamp including a first filament and a second filament with automatic current switching between the first element and the second element when the first element opens due to a failure and further having a separating cold cathode getter plate disposed between the first filament and the second filament.

9 Claims, 1 Drawing Sheet

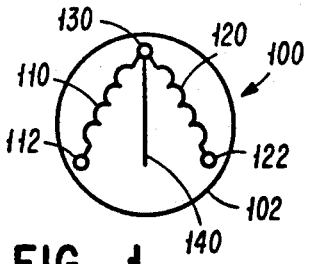
FIG. 1
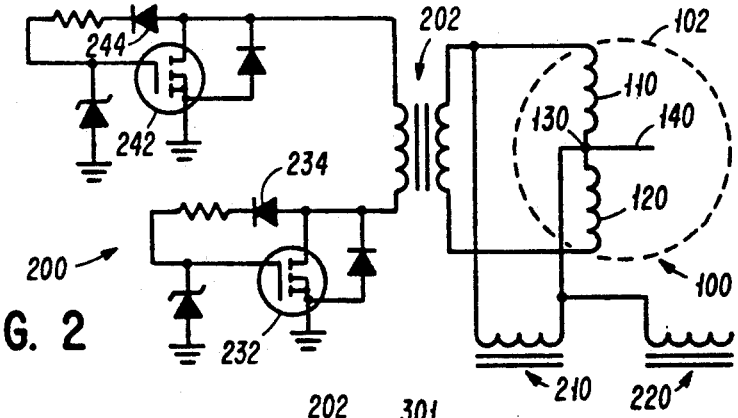
FIG. 2
FIG. 3
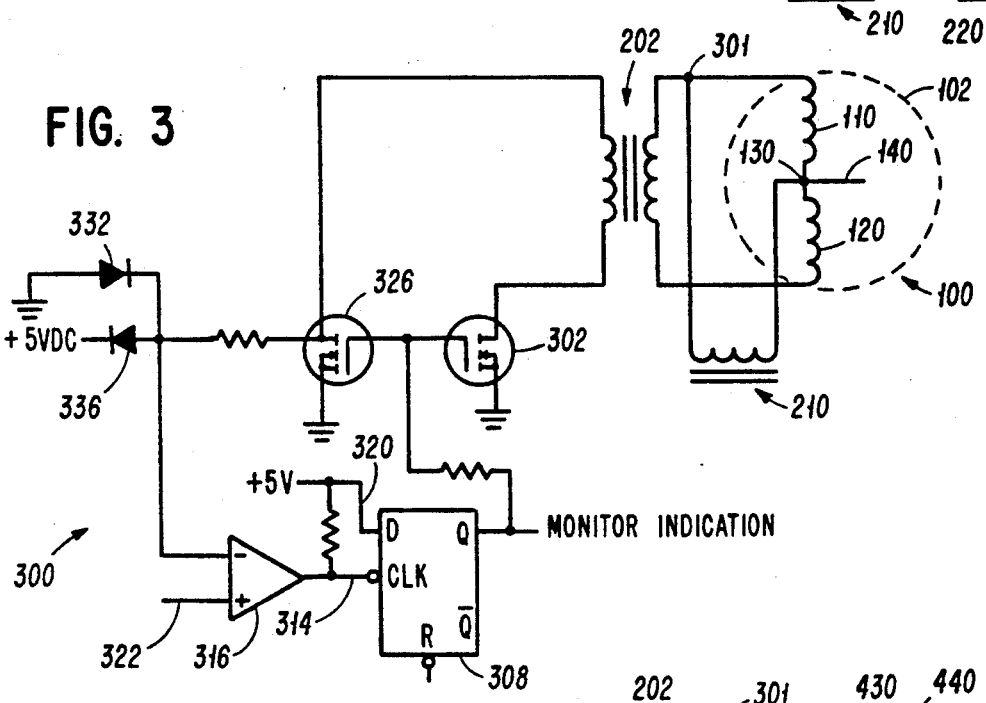
FIG. 4
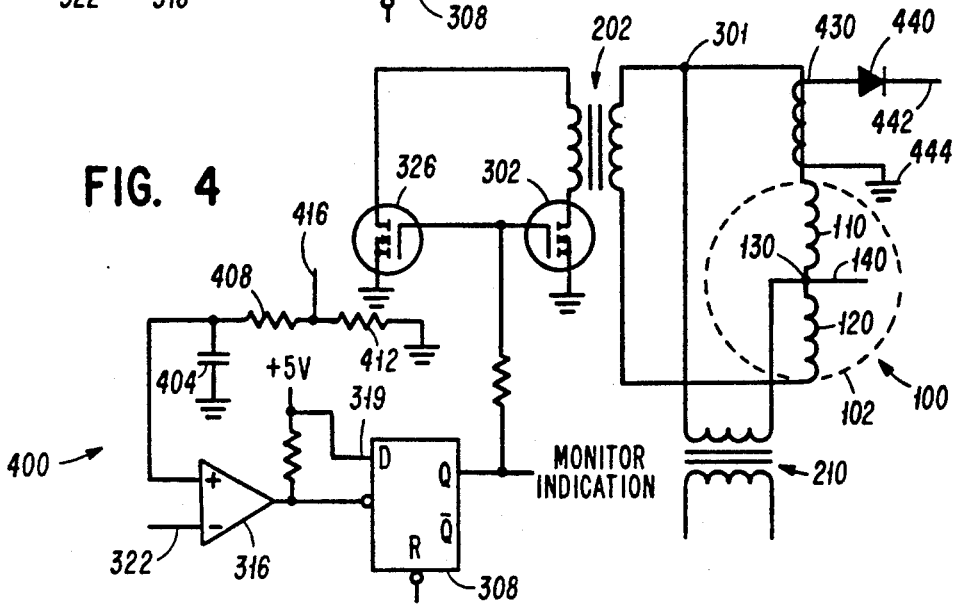

DUAL FILAMENT LAMP AND DRIVE APPARATUS FOR DIMMABLE AVIONICS DISPLAYS

CROSS REFERENCE

This application is a continuation in part application of co-pending application entitled "Improved Method And Apparatus For Driving A Gas Discharge Lamp" filed on Jun. 4, 1991 by the same inventor and assigned to the same assignee and having Ser. No. 07/709,942, now U.S. Pat. No. 5,250,877; which is incorporated herein in its entirety by this reference.

FIELD OF THE INVENTION

The present invention generally relates to backlighted liquid crystal displays, and even more particularly concerns dimmable fluorescent backlighted liquid crystal displays, and even more particularly concerns dual filament automatic reversion dimmable fluorescent backlighted liquid crystal avionics displays.

BACKGROUND OF THE INVENTION

In the past, avionics displays have been called upon to perform in extreme environmental conditions. The typical cockpit display device needs to be visible in a bright sunlit cockpit at 40,000 feet at noon and also viewable in a dark moonless cockpit at midnight. Consequently, it has been desirable to have a backlighted liquid crystal display with a wide dimming range to accommodate the extreme ambient light conditions.

Additionally, there has been a seemingly never ending quest for avionics engineers to extend the bulb life for fluorescent lamps (i.e. increase the time between bulb replacements).

In the past, dual filament lamps have been proposed such as in U.S. Pat. No. 4,734,616 entitled "Fluorescent Lamp with Double Cathode and Probe", which was issued to Donald P. Northrop on Mar. 29, 1988; which patent is incorporated herein in its entirety by this reference. This patent shows the use of dual filaments in order to extend bulb life. However, this and similar designs have several serious drawbacks.

First of all, these lamps are not dimmable over a wide range which is needed for avionics applications.

Secondly, when the first filament burns out in the Northrop design it causes some material to be deposited on the second filament.

Consequently, there exists a need for improvement in fluorescent lamps used in the avionics areas.

SUMMARY OF THE INVENTION

It is an object of the present invention to provide a fluorescent lamp with enhanced reliability.

It is a feature of the present invention to include dual filaments separated by a getter plate.

It is an advantage of the present invention to provide an alternate uncontaminated filament within the fluorescent lamp which can be used when a first filament burns out.

It is another object of the present invention to provide dimmability of the dual filament fluorescent lamp.

It is another feature of the present invention to provide a pair of filaments at each end of the fluorescent lamp with a common terminal between the pair.

It is another advantage of the present invention to provide dimmability with one filament of the pair as well as the other.

It is yet another object of the present invention to provide for uninterrupted performance of the fluorescent lamp when a first filament burns out.

It is yet another feature of the present invention to include automatic reversion means for automatically switching the current from the first filament to the second filament when the first filament burns out. It is yet another feature of the present invention to provide switching circuitry for switching the currents from the first filament to the second filament while also providing a notification signal that such switch has taken place, the notification signal is provided to an external monitor.

The present invention provides a dual filament dimmable fluorescent lamp for use in avionics displays, which is designed to satisfy the aforementioned needs, produced the earlier mentioned objects, contained the above described features, and achieved the previously stated advantages. The invention is carried out in a "contaminant-less" system in the sense that the contamination of one adjacent filament due to the extinguishing of another filament is reduced. In the present invention a getter plate is added between the pair of filaments at the end of the fluorescent lamp. Additionally, the present invention is carried out in a "dual dimmer-less" fashion in a sense that separate dimmer controls for each filament in a filament pair are not needed. Instead, the filaments of a pair share a common terminal for driving and dimming purposes.

BRIEF DESCRIPTION OF THE DRAWINGS

The invention may be more fully understood by reading the following detailed description in conjunction with the appended drawings wherein;

FIG. 1 is a cross sectional view of a dual filament fluorescent lamp bulb of the present invention.

FIG. 2 is an electronics schematic drawing of a drive apparatus for a dual filament lamp of the present invention.

FIG. 3 is an electronics schematic drawing of a drive apparatus for a dual filament lamp of the present invention which includes an automatic reversion capability for a current driven lamp filament.

FIG. 4 is an electronics schematic drawing of a drive apparatus for a dual filament lamp of the present invention which includes an automatic reversion capability for a voltage driven lamp filament.

DETAILED DESCRIPTION

Now referring to the drawings wherein like numerals refer to like structure and text throughout.

Now referring to FIG. 1, there is shown a cross-sectional view of the lamp bulb of the present invention, generally designated 100, having a glass cylinder 102 therein, which is well known in the art, with a first filament 110 and a second filament 120 disposed therein both of which are well known in the art. Filaments 110 and 120 are shown coupled to base pin contact and filament mounts 112 and 122 respectively. Additionally, filaments 110 and 120 are connected to one another at common terminal pin contact and filament mount 130. Extending from common terminal pin contact and filament mount 130 and disposed between filaments 110 and 120 is getter plate 140, which is preferably coated with an emissive material in order to act as a cold cathode, when necessary.

In operation, current is caused to flow through the first filament 110 and not through second filament 120. When filament 110 no longer operates and the circuit through it opens, the current through it automatically reverts to filament 120(see discussion below regarding FIGS. 2, 3 & 4). The change in current results in a change in heat dissipation by each filament and therefore results in a changed convection within the lamp. Getter plate 140 is disposed between the filaments 110 and 120 in order to inhibit the flow of contaminants from one operating filament to the other standby operable filament. When both filaments have ceased operating and are opened, then the getter plate 140 acts as a cold cathode providing light(without dimmability) until the aircraft lands and can be safely serviced.

Now referring to FIG. 2 there is shown an electronic schematic diagram, of the present invention, generally designated 200 including lamp bulb 100 of FIG. 1.

In operation, the lamp bulb and magnetic switching device, of the present invention, can be described as follows:

Case 1—If both filaments are operable the filament drive current flows from the current drive transformer 210 through filament 110 and returns to the current drive transformer 210. Since filament 110 is low impedance, relative to the winding of transformer 202, it is the path of current flow. Filament 120 remains nonenergized since it can only return a current through the winding of transformer 202. The fluorescent lamp arc will be produced by filament 110, since it is hot and therefore most emissive.

Case 2—If filament 110 fails the typical tungsten wire will open and then the only current path for the current source from current drive transformer 210 is now through transformer 202. Since transformer 202 preferably has a large winding inductance, a voltage transient will be created. When reflected to the primary, this transient will forward bias diodes 244 and 234 in alternating half cycles. Since the MOSFET transistors 242 and 232 have a large gate capacitance, both require only microamps of gate current to be held in the "on" state. The transient can be used to latch them "on". Once the FETs 242 and 232 are "on", the primary voltage will drop. Diodes 244 and 234 will become reversed biased. The charge built on the gate capacitance will hold the FETs 242 and 232 "on". With both 242 and 232 "on", the core of transformer 202 will saturate and lose permeability. The winding inductance of transformer 202 will now be substantially lower. Filament 120 will now receive current from current drive transformer 210, through the shunted winding of transformer 202. The arc will be produced from the more emissive filament 120.

Case 3—If both filaments 110 and 120 fail then the lamp can no longer operate in the hot cathode mode, if the getter plate 140 is covered in emissive coating, the lamp will continue to operate as a cold cathode device. This could be used for hours of in-flight failure serviceability allowing the display to remain useful until the lamp can be replaced. Another purpose of the getter plate 140 is to protect the nonoperating filament from becoming contaminated by the operating filaments sputter. Once the first filament breaks the getter plate 140 also prevents physical contact between the two filaments.

While a common practice for powering fluorescent lamp filaments is frequently to apply a voltage across the filament, certain distinct advantages exist when filaments are powered by a current source. The dual filament lamp drive apparatus, of the present invention is preferred to have a current drive scheme. However, the following discussions are preferred embodiments for automatic reversion from the first filament to the second filament for a current drive system and voltage drive system in FIGS. 3 and 4 respectively.

Now referring to FIG. 3, there is shown a latching method and apparatus for automatic reversion of a dual filament drive in a current driven system. The apparatus, generally designated 300, includes the lamp bulb 100 of FIGS. 1 and 2 and also includes shunt transformer 202 which acts as a magnetic switch. In this scheme, when filament 110 opens (i.e. fails) a very high voltage is developed at point 301 caused by the current drive transformer 210 driving a high impedance. (FETs 326 and 302 are both off at this point). Comparator 316 which is preferably a LM119 or the like senses this high voltage. The output of comparator 316 falls to a low logic state. This in turn latches the "Q" output of chip 308 to a logic "one" or high state period this will now drive FETs 326 and 302 to an "on" state. Chip 308 is preferably a x4Hc74 or the like. With FETs 326 and 302 both on transformer 202 starts to conduct. A current path is now complete to energize filament 120. Diodes 332 and 336, which preferably are IN4454, and resistor 330 are provided to clamp excessive voltage spikes from damaging comparator 316.

Now referring to FIG. 4 there is shown a latching scheme and apparatus for automatic reversion in a voltage driven dual filament fluorescent lamp.

In a voltage driven system it is desirable to measure the average current of filament 110. This current is then compared to a reference voltage. (As was the transformer voltage in the previous case). Diode 440, resistors 408 and 412, and capacitor 404 constitute a filament average current sensing circuit. The average current is compared against a threshold $V_{ref}$ by comparator 316. When the filament 110 opens, the average current falls, and chip 308 latches FETs 326 and 302 on, since current flow and this average current to filament 110, will not resume after filament 110 opens.

While the above description highlights the importance of the present invention for avionics displays, it is equally applicable to other uses of liquid crystal displays such as laptop computers, etc. The above description focusing on avionics displays is therefore intended only as an example of the many possible use for the present invention.

It is thought that the improved fluorescent lamp and drive apparatus, of the present invention and many of its attendant advantages will be understood from the foregoing description, and it will be apparent that various changes will be made in the form, construction, and arrangement of the parts thereof without departing from the spirit and scope of the invention, or sacrificing all of their material advantages, the forms here and before described being barely preferred or exemplary embodiments thereof.

I claim:

1. A dimmable fluorescent backlight for displays comprising;

a fluorescent lamp bulb having a first end and a second end;

disposed at said first end of said fluorescent lamp bulb is a plurality of first end filaments;

disposed at said second end of said fluorescent lamp bulb is a plurality of second end filaments;

first current source means for providing a current through a first one of said plurality of first end filaments; and, current switching means for isolating a second one of said plurality of first end filaments when said first one of said plurality of first end filaments is provided with said current therethrough, and further for switching said current through said second one of said plurality of first end filaments when said first one of said plurality of first end filaments fails.

2. A backlight of claim 1 further comprising; second current source means for providing a current through a first one of said plurality of second end filaments; and, second current switching means for isolating a second one of said plurality of second end filaments when said first one of said plurality of second end filaments is provided with said current therethrough and further for switching said current through said second one of said plurality of second end filaments when said first one of said plurality of second end filaments fails.

3. A backlight of claim 1 wherein said plurality of first end filaments comprises;

an initial first end filament having a first basepin end and a first terminal end;

a second first end filament having a second basepin end and a second terminal end;

wherein said first terminal end and said second terminal end are connected;

a transformer having a switch side winding and a bulb side winding wherein said bulb side winding of said transformer further has a first winding end and a second winding end;

said first basepin end of said initial first end filament being coupled with said first winding end; and, said second winding end being connected with said second basepin end.

4. A backlight of claim 3 further comprising;

a second transformer having a lamp side winding with a winding terminal end and a winding first filament end wherein said winding terminal end is coupled with said first terminal end, said second terminal end and said winding first filament end is coupled with said first basepin end of said initial first end filament.

5. An improved fluorescent backlight for avionics displays comprising;

a fluorescent tube having a first filament disposed therein and a second filament disposed therein; and, a getter plate coupled with and separating said first filament and second filament.

6. A fluorescent backlight of claim 5 further comprising;

means for alternately switching a current from said first filament to said second filament when said first filament fails.

7. A backlight of claim 6 wherein said getter plate has an emissive coating disposed thereon.

8. A backlight of claim 7 wherein said means for switching a current further provides means for providing a notification signal that said current has been switched.

9. An improved fluorescent lamp apparatus comprising;

a primary filament having a winding primary end and a primary terminal end;

a backup filament having a winding backup end and a backup terminal end;

transformer means for providing current for filament power, having a winding terminal end and a winding filament end;

said winding terminal end connected with said primary terminal end and said backup terminal end;

said winding filament end directly connected to said winding primary end and coupled to said winding backup end through a second transformer;

a latching means coupled with said second transformer, for switching the operation of said second transformer in response to a failure of said primary filaments; and, said latching means further providing an indication signal in response to said failure of said primary filament.

* * * * *